US005867815A

United States Patent [19]

Kondo et al.

[11] Patent Number: 5,867,815

[45] Date of Patent: Feb. 2, 1999

[54] METHOD AND DEVICE FOR CONTROLLING THE LEVELS OF VOICED SPEECH, UNVOICED SPEECH, AND NOISE FOR TRANSMISSION AND REPRODUCTION

[75] Inventors: Kazunobu Kondo; Akitoshi Saito, both of Shizuoka-ken, Japan

[73] Assignee: Yamaha Corporation, Hamamatsu, Japan

[21] Appl. No.: 528,851

[22] Filed: Sep. 15, 1995

[30] Foreign Application Priority Data

Sep. 29, 1994 [JP] Japan ..... 6-259195

[51] Int. Cl.[6] ..... G10L 3/02

[52] U.S. Cl. ..... 704/228; 704/208; 704/226; 704/233

[58] Field of Search ..... 395/2.14, 2.24, 395/2.19, 2.17, 2.1, 2.35, 2.33, 2.34, 2.36, 2.37, 2.42, 2.43, 2.57, 2.62, 2.77; 704/200

[56] References Cited

U.S. PATENT DOCUMENTS

| | | | |
|---|---|---|---|
| 5,097,510 | 3/1992 | Graupe | 395/2.42 |
| 5,133,013 | 7/1992 | Munday | 395/2.35 |
| 5,228,088 | 7/1993 | Kane et al. | 395/2.42 |
| 5,280,561 | 1/1994 | Satoh et al. | 395/2.09 |
| 5,293,450 | 3/1994 | Kane et al. | 395/2.35 |
| 5,406,635 | 4/1995 | Jarvinen | 381/94 |
| 5,414,796 | 5/1995 | Jacobs et al. | 395/2.3 |
| 5,479,560 | 12/1995 | Mekata | 395/2.18 |

*Primary Examiner*—David R. Hudspeth
*Assistant Examiner*—Donald L. Storm
*Attorney, Agent, or Firm*—Loeb & Loeb LLP

[57] ABSTRACT

An encoding apparatus provided at the transmission side includes a low pass filter, a high pass filter, a nonvoice band detecter, a switch and an adder for separating a speech component and a background noise component from an inputted signal. The low pass filter provides a voice band of the speech component and the high pass filter provides a nonvoice band of the speech component. The nonvoice band component is separated from the background noise portion of the output of the high pass filter and re-combined with the voice band to provide the separated speech component. The separated speech component and the background component are individually encoded by a speech encoder and a noise encoder, respectively, and transmitted. In a decoding apparatus at the reception side, the speech component and the background noise component are individually decoded by a speech decoder and a noise decoder, respectively. The decoded speech component and the background noise component are level-adjusted based upon an appropriate level ratio by level controllers, respectively, and then mixed by an adder and outputted as a reproduced signal.

17 Claims, 5 Drawing Sheets

METHOD AND DEVICE FOR CONTROLLING THE LEVELS OF VOICED SPEECH, UNVOICED SPEECH, AND NOISE FOR TRANSMISSION AND REPRODUCTION

BACKGROUND OF THE INVENTION

1. Field of the Invention

The present invention relates to a speech transmission/reception system, such as a telephone or the like, for transmission and reception of speech.

2. Description of Related Art

As mobile telephone equipment has become more popular, people make phone calls in various places. These calls occur more often in environments where there are a lot of noises around the speaker. For example, an increasing number of people make phone calls during meetings or in the public transportation system, such as on a subway, a train and a bus. When a phone call is made from a noisy environment, or a telephone conversation has to be held at a low level, it is often difficult for a person at the receiving side to hear the speaker at the transmission side. To improve the clarity of speech to be heard at the receiving side, for example, a speaker on the transmitter side may have to cover the telephone transmitter by hand to prevent background noises including other persons' voice from entering the telephone transmitter.

SUMMARY OF THE INVENTION

It is an object of an embodiment of the present invention to address the above-mentioned problems. It is another object of embodiments of the present invention to provide a speech transmission/reception system in which speech can be clearly heard at the receiving side without regard to the background noises and other persons' voices at the transmission side.

A speech transmission/reception system in accordance with an embodiment of the present invention transmits and receives signals including speech signals between a transmission side and a reception side. The speech transmission/reception system includes a discrimination device that discriminates an inputted signal into a voice band component, a nonvoice band component and a noise component. In one embodiment, the voice band component and the nonvoice band component together form a speech signal that is generated by a speaker, and the noise component derives from background noises other than the speech signal. A level control device is provided to control respective signal levels among the voice band component, the nonvoice band component and the background noise component that are discriminated by the discrimination device according to a set level ratio. The system further includes a reproducing device that mixes the voice band component, the nonvoice band component and the background noise component based upon the level ratio to generate a reproduced signal.

In accordance with an embodiment, the level control device may be provided at either the reception side or the transmission side. When the level control device is provided at the reception side, the levels of the voice band component, the nonvoice band component and the background noise component may be adjusted based upon a specified level ratio. In an alternative embodiment, the levels of the voice band component, the nonvoice band component and the background noise component may be adjusted based upon a level of the background noise component that is received.

In accordance with embodiments of the present invention, an input signal is generally composed of a speech signal component and a background noise component, wherein the speech signal component is formed by a voice band component and a nonvoice band component. The input signal is discriminated into the voice band component, the nonvoice band component and the background noise component, and the respective signal levels among the speech signal component including the nonvoice band and the background noise component are properly adjusted. Thereafter, the speech signal component and the background noise component are mixed to generate a reproduced signal. As a result, if the level of the background noise component is high as compared with the level of the speech signal component, or the level of the speech signal component is low, the level ratio between the background noise component and the speech signal component is appropriately adjusted to increase the clarity of the reproduced speech signal.

Other features and advantages of the invention will be apparent from the following detailed description, taken in conjunction with the accompanying drawings which illustrate, by way of example, various features of embodiments of the invention.

DETAILED DESCRIPTION OF EMBODIMENTS

Embodiments of the present invention are described hereunder with reference to the accompanying drawings.

Figure 1:
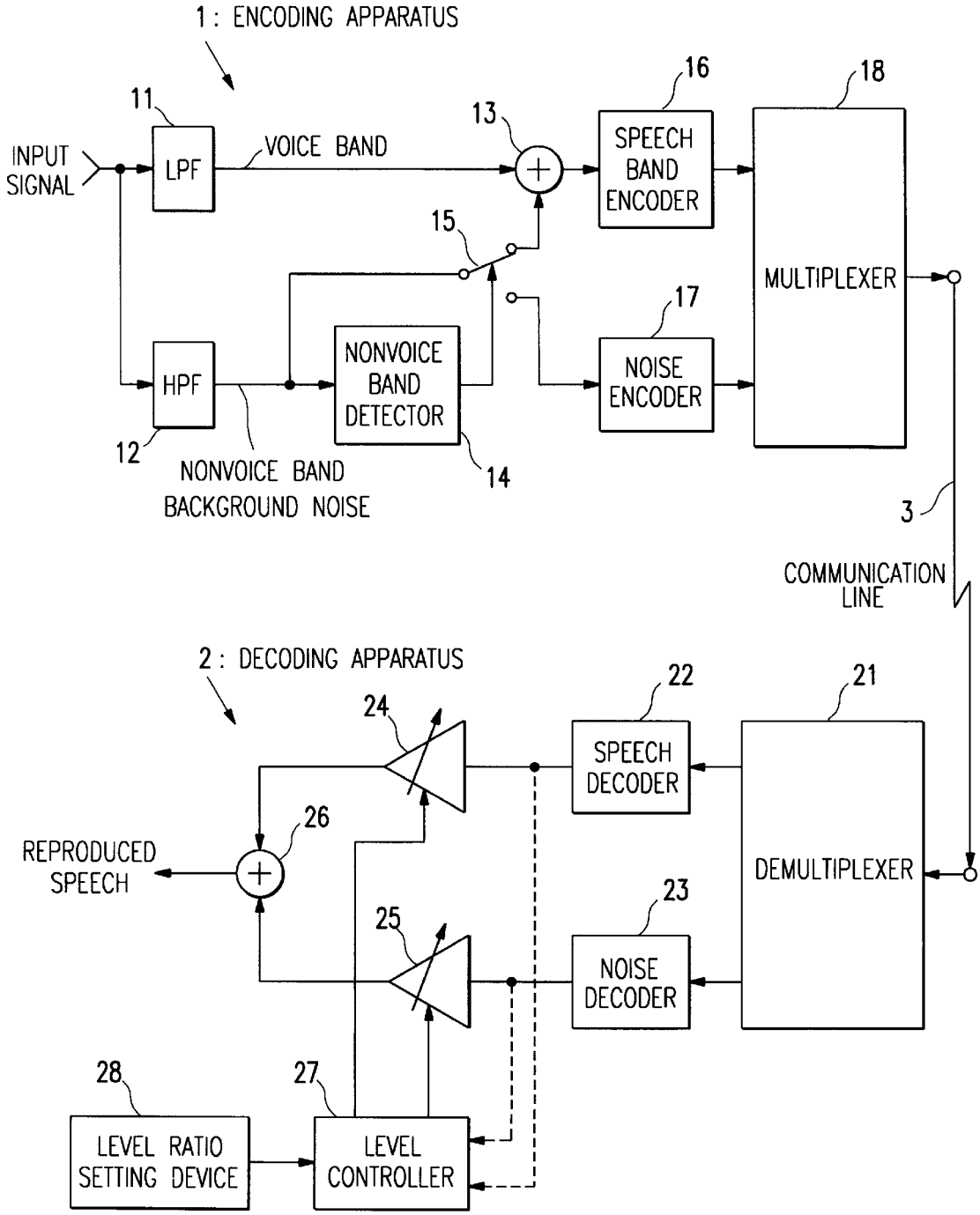
FIG. 1 shows a block diagram of a speech transmission/reception system in accordance with a first embodiment of the present invention.

FIG. 1 shows a block diagram of a speech transmission/reception system in accordance with a first embodiment of the present invention.

The system includes an encoding apparatus 1 at the transmission side, a decoding apparatus 2 at the receiving side and a communication line 3, such as a telephone line, that connects these two apparatuses. However, alternative embodiments may be wireless using radio links or the like, or a combination of wireless and lines.

Figure 2:
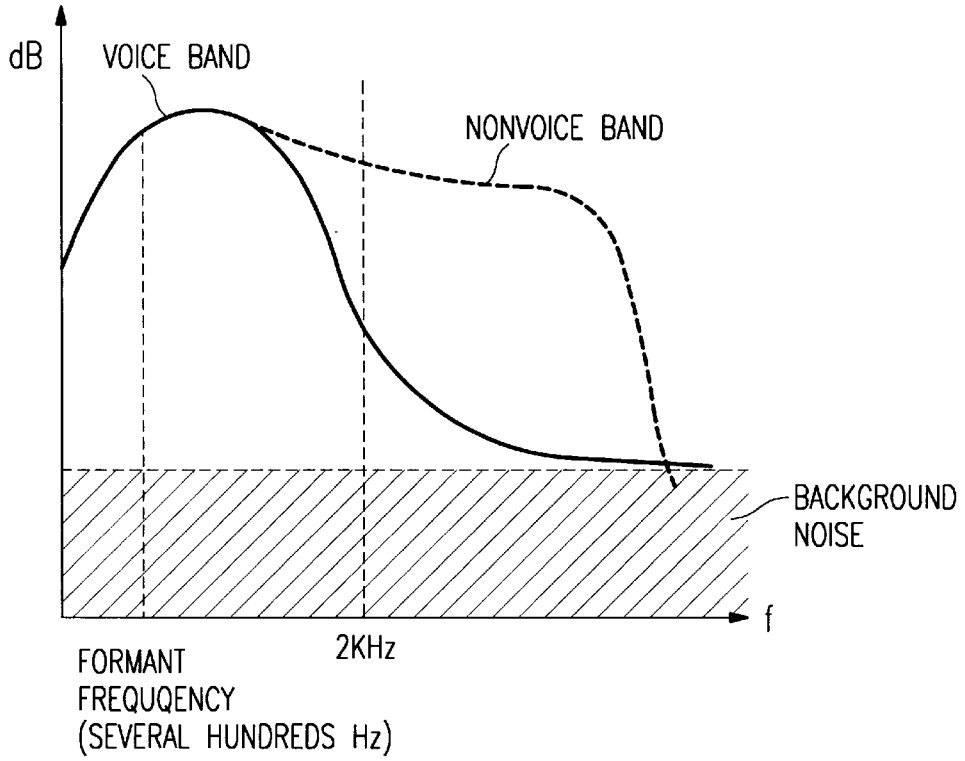
FIG. 2 is a graph showing the frequency characteristics of an input signal including speech signal that may be inputted in the system shown in FIG. 1.

In the encoding apparatus 1, a signal is inputted into a low pass filter (LPF) 11 and a high pass filter (HPF) 12 for separating the signal into a low frequency component and a high frequency component. For example, when a person is talking to a telephone transmitter, the input signal typically includes a speech signal and a background noise signal. The speech signal is generally composed of a voice band and a nonvoice band. As shown in FIG. 2, a voice band in the speech signal in particular has a distribution in a lower frequency region that is centered about a format frequency (or characteristic frequency) (i.e., approximately several hundreds Hz), and a nonvoice band and background noises are distributed in a higher frequency region of the speech signal. Therefore, the LPF 11 separates a voice band component from the input speech signal, and the HPF 12 separates a background noise component and a nonvoice band component from the input signal. The separated voice band component is provided to one input terminal of an adder 13. The separated background noise and nonvoice band components are inputted to a nonvoice band detector 14.

While the background noise is quasi-stationary (i.e., generally level), the nonvoice band has a large time-variation. Based upon these characteristics, the nonvoice band detector 14 detects a signal that has an abrupt time-variation as a nonvoice band.

Figure 3:
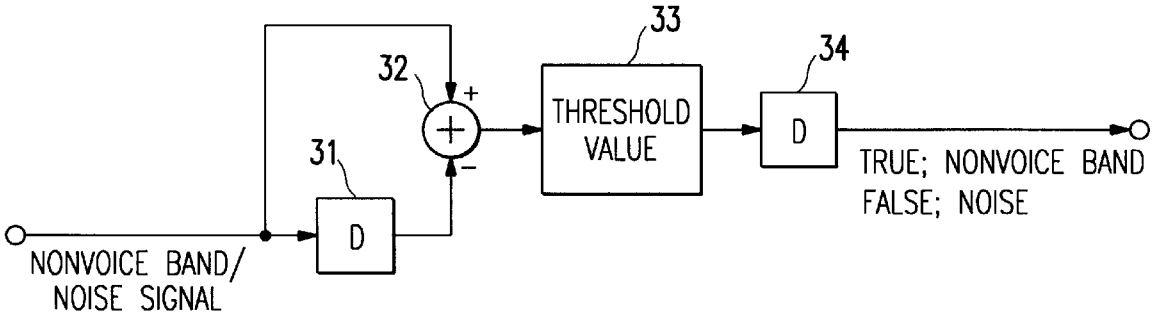
FIG. 3 shows a block diagram of a nonvoice band detector in accordance with the embodiment of the present invention in the system shown in FIG. 1.

The nonvoice band detector 14 may be formed by, for example, a circuit embodiment shown in FIG. 3. In this circuit, a nonvoice band/background noise signal is inputted to a delay circuit 31 to cause a delay, and a subtracter 32 performs subtraction between the nonvoice band/background noise signal and the delayed signal. A level obtained as a result of the subtraction is determined by a threshold value circuit 33. A determination result is outputted through a delay circuit 34 as a detection signal. When the delay amount of the delay circuit 31 is set to be slightly longer than the time for an abrupt level variation that may be typically caused by a nonvoice band, the detection signal is outputted only when a level variation abruptly occurs, in other words, when a nonvoice band occurs.

Figure 4:
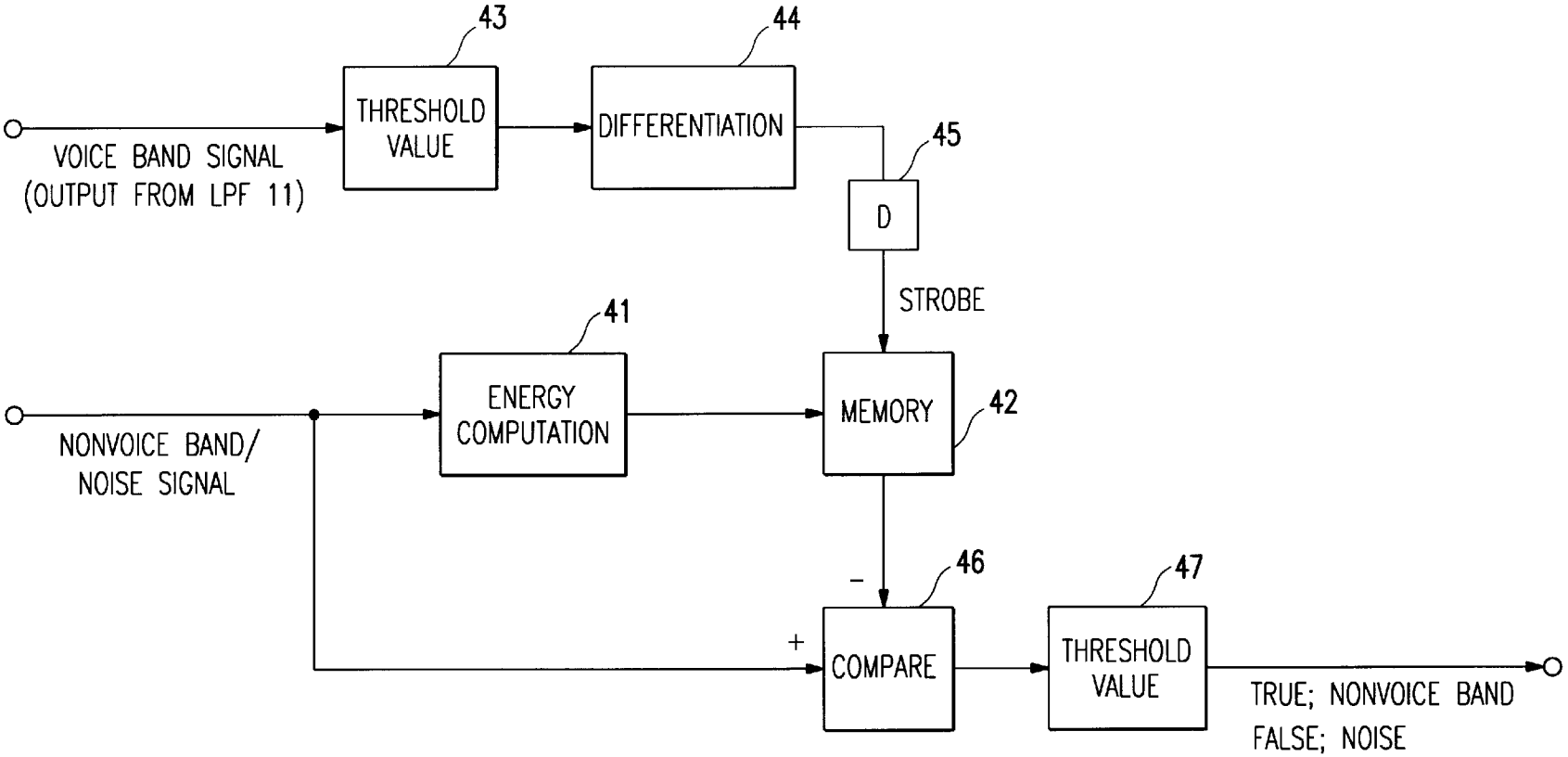
FIG. 4 shows a block diagram of a nonvoice band detector in accordance with a second embodiment of the present invention in the system shown in FIG. 1.

Another embodiment circuit for the nonvoice band detector 14 is shown in FIG. 4. A nonvoice/background noise signal is inputted into an energy calculation circuit 41 to measure the energy level of the signal. The measured energy level is inputted into a memory 42. On the other hand, a threshold value circuit 43 detects a voice band signal provided from the LPF 11 if the gain of the voice band signal exceeds a predetermined level. A differentiating circuit 44 differentiates the fall portion of the detected voice band signal provided by the threshold value circuit 43. A delay circuit 45 causes a slight delay to the differentiated pulse in order to synchronize the timing of the differentiated pulse with the output timing of the energy calculation circuit 41. The delayed pulse is provided as a stored signal to the memory 42. The stored energy value and the silence/background noise signal are compared by a comparator 46 at the timing of the stored signal. A threshold value circuit 47 detects if a difference between the stored energy value and the silence/background noise signal is larger than a predetermined threshold value, and outputs a detection result as a nonvoice band detection signal. Thus in accordance with the circuit as shown in FIG. 4, the energy of the background noise at the fall time of the speech signal (which does not include the nonvoice band) is used as a reference level for the detection of a signal including nonvoice band. As a result, nonvoice band is more accurately detected.

The detected signal generated in a manner described above is provided to a switch 15 shown in FIG. 1 as a selection signal. The switch 15 provides an output of the HPF 12 to another input terminal of the adder 13 when a nonvoice band is detected by the nonvoice band detector 14. The adder 13 mixes voice band and nonvoice band to generate a mixed signal and provides the mixed signal to a speech encoder 16. On the other hand, the switch 15 provides an output of the HPF to an input terminal of a noise encoder 17 when a nonvoice band is not detected. As a result, a speech component including a nonvoice band is separated from a background noise component. Then, the speech encoder 16 and the noise encoder 17 independently encode the speech component and the background component, respectively. The encoded signal outputs are thus multiplexed by a multiplexer 18 and transmitted through the communication line 3 to the decoding apparatus 2.

A signal transmitted through the communication line 3 and received by the decoding apparatus 2 is divided by a demultiplexer 21 into a speech signal code and a noise code. The speech signal code and the noise code are decoded by a speech decoder 22 and a noise decoder 23, respectively. The decoded signals are level-adjusted by gain circuits or amplifiers 24 and 25, respectively, mixed by an adder 26 and outputted as a reproduced signal that includes a reproduced speech.

The gain circuits 24 and 25 adjust the gain of each of the speech component and the background noise component to maintain the respective signal levels of these components at a predetermined level ratio provided by a level controller 27. The level ratio may be set by a level ratio setting device 28. For example, a person at the reception side, while listening to the reproduced signal, can set the speech signal and the background noise independently to optimize the signal to preferred levels.

Alternatively, a level output of the speech decoder 22 and a level output of the noise decoder 23 may be inputted into the level controller 27 as shown in dashed lines, and the level controller 27 may set the respective gains at the gain circuits 24 and 25 to maintain the ratio of the respective signal levels at the outputs of the gain circuits 24 and 25 a specified value. For example, even when the background noise is large, or the speech signal is small, the level ratio between the speech signal and the background noise can be adjusted to a specified value level.

Figure 5:
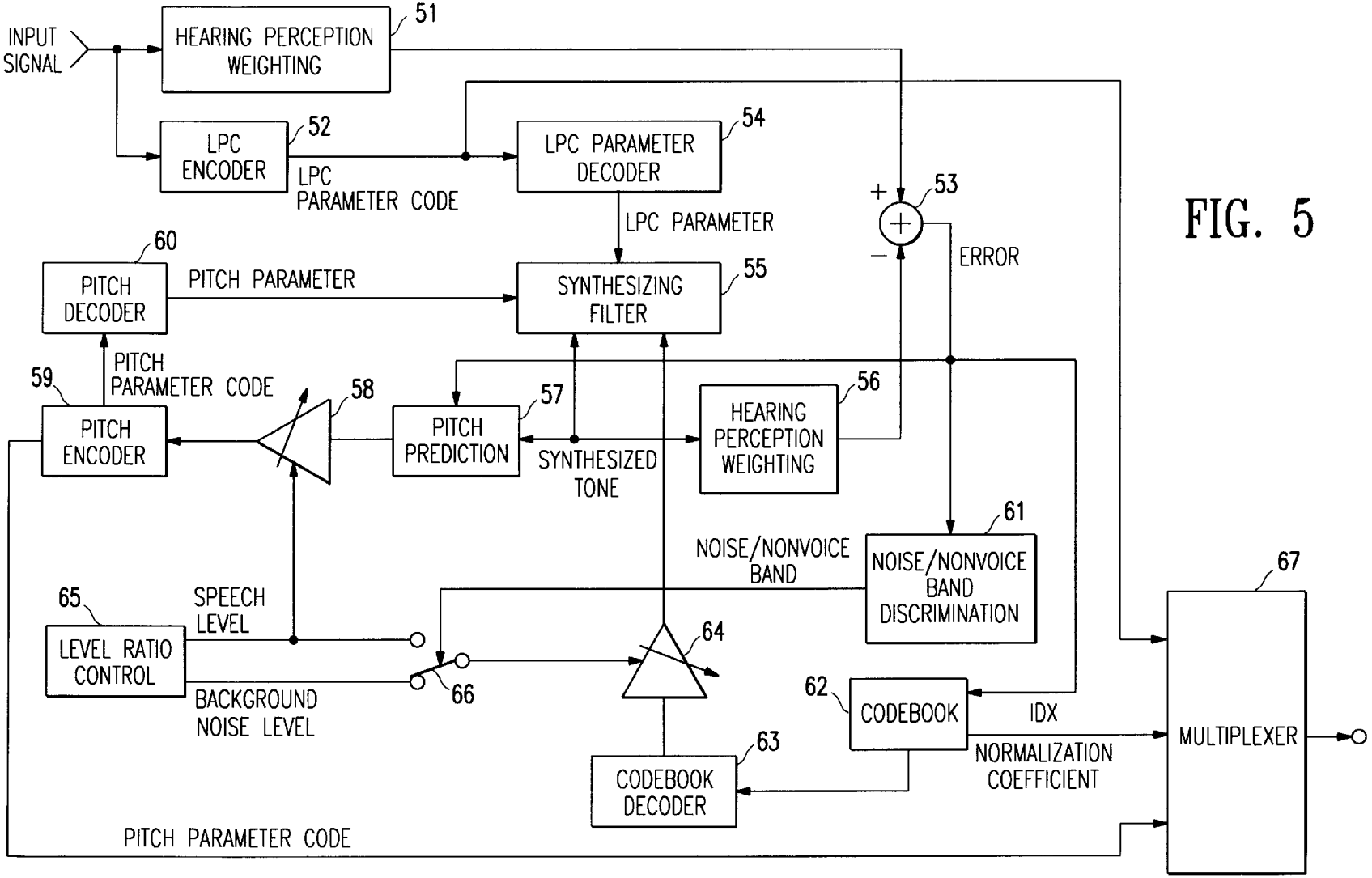
FIG. 5 shows a block diagram of an encoding apparatus in a speech transmission/reception system in accordance with an embodiment of the present invention.
Figure 6:
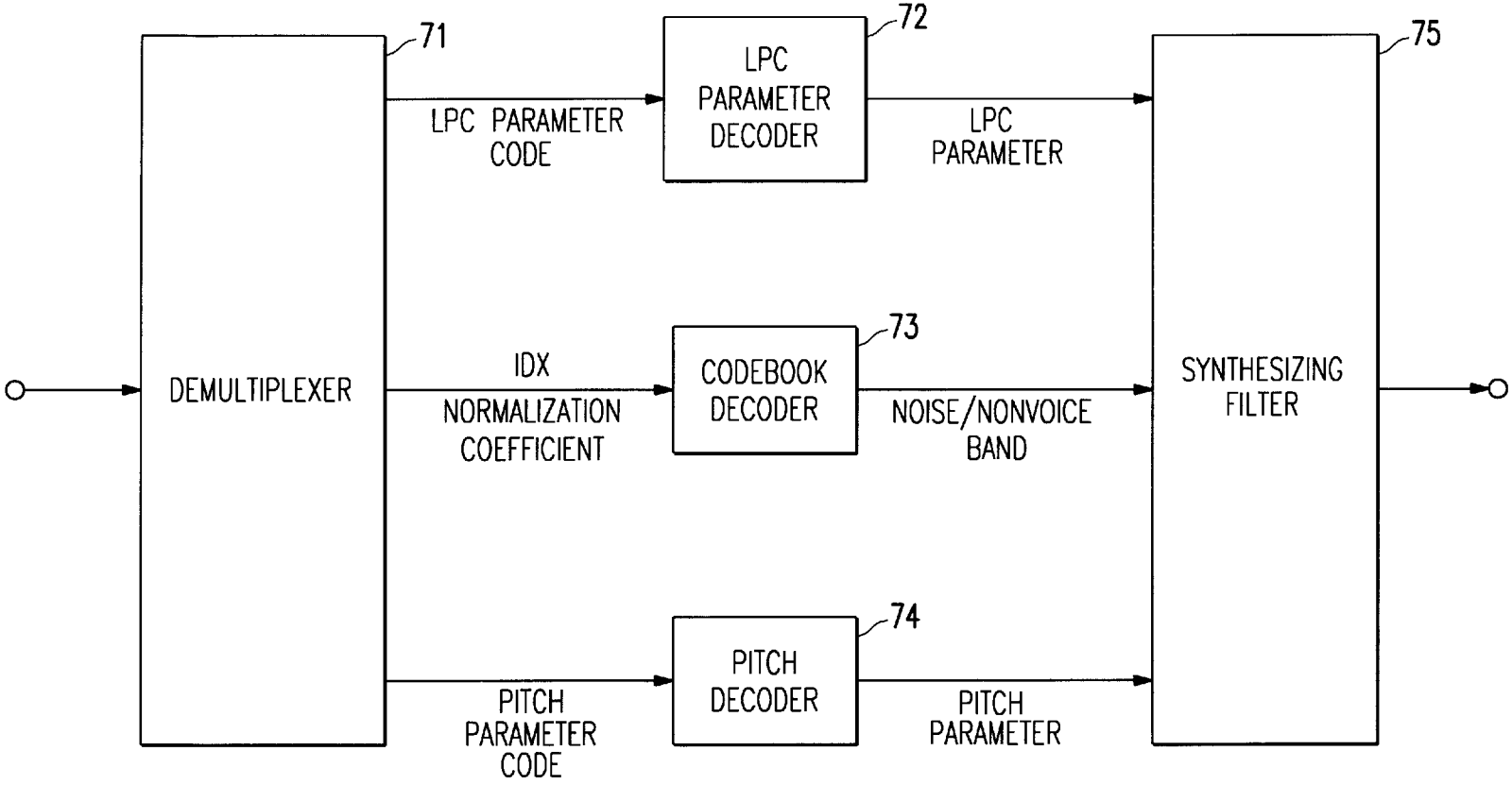
FIG. 6 shows a block diagram of a decoding apparatus in the system shown in FIG. 5.

FIGS. 5 and 6 show a speech transmission/reception system in accordance with a second embodiment of the present invention which uses an analysis-by-synthesis encoding system. FIG. 5 shows a block diagram of an encoding apparatus, and FIG. 6 shows a block diagram of a decoding apparatus.

As shown in FIG. 5, an input signal including a speech-signal is provided to a hearing perception weighting filter 51 and a linear predictive coding (LPC) encoder 52. The hearing perception weighting filter 51, based upon its specified masking characteristics, cuts signal components which exist adjacent high frequency components, and which do not affect the hearing perception. An output of the hearing perception weighting filter 51 is supplied to one input terminal of a subtracter 53.

On the other hand, the LPC encoder 52 uses linear-prediction to encode the input signal, based upon the covariance method or autocorrelation method, and then calculates an LPC parameter represented by the pole of an all-pole type synthesis filter. The LPC parameter represents the format frequency. Finally, the LPC encoder 52 outputs an LPC parameter code that specifies the LPC parameter. The LPC parameter code is decoded once by an LPC parameter decoder 54 and provided to a synthesizing filter 55. As described later, a pitch parameter and a noise/nonvoice band signal are also inputted into the synthesizing filter 55. The synthesizing filter 55 mixes them to generate a synthesized tone and outputs the same. The synthesized tone is weighted by a hearing perception weighting filter 56 and compared by the subtracter 53 with an output from the hearing perception weighting filter 51 to obtain an error power. The synthesized tone provided by the synthesizing filter 55 is also inputted into a pitch prediction filter 57, in which pitch information for the minimum error power is extracted. The pitch information is level-adjusted by a level controller 58, encoded by a pitch encoder 59, further decoded by a pitch decoder 60, and then provided to the synthesizing filter 55 as the above-mentioned pitch parameter.

The error power outputted from the subtracter 53 is a signal in which a voice band component has been removed from the inputted speech. Therefore, this signal is inputted into a noise/nonvoice band discriminator 61 to determine whether the signal is noise or a nonvoice band. As an alternative discrimination method, one of the above-described methods using time-variation of a nonvoice band may be used. The signal subjected to the discrimination process in the noise/nonvoice band discriminator 61 is vector-quantized using a codebook 62 wherein an index IDX corresponding to the code vector and a normalization coefficient are obtained. The noise/nonvoice band is decoded once by a codebook decoder 63 based upon the index IDX and the normalization coefficient, level-adjusted by a level controller 64, and then provided to the synthesizing filter 55 as the above-described noise/nonvoice band signal.

Furthermore, the encoding apparatus includes a level ratio controller 65. The level ratio controller 65 controls the ratio between a voice band level and background noise level so that the ratio takes a specified value. The level ratio controller 65 adjusts the level controller 58 so that an output from the pitch prediction filter 57 takes on an appropriate tone level. With respect to the noise/nonvoice band signal from the codebook decoder 63, a switch 66 is used in response to the discrimination result provided by the noise/nonvoice band discriminator 61. For example, when an output from the codebook decoder 63 is background noise, the switch 66 is used so that the level controller 64 is controlled, for example, to reduce the background noise level. When an output from the codebook decoder 63 is a noise/nonvoice band, the switch 66 is used so that the level controller 64 is controlled, for example, to amplify the voice band level. Therefore, the normalization coefficient obtained by the codebook 62 is a small value for the background noise, and a large value for the nonvoice band.

While the above-mentioned control is performed, the LPC parameter code from the LPC encoder 52, the index IDX and the normalization coefficient from the codebook 62 and the pitch parameter code from the pitch encoder 59 are multiplexed by a multiplexer 67, and then transmitted to the decoding apparatus side.

At the decoding apparatus side as shown in FIG. 6, the received signal is divided by a demultiplexer 71 into the LPC parameter code, the index IDX and the normalization coefficient, and the pitch parameter code. The LPC parameter code, the index IDX and the normalization coefficient, and the pitch parameter code are decoded by an LPC parameter decoder 72, a codebook decoder 73 and a pitch decoder 74, respectively, and then mixed by a synthesizing filter 75 to provide a reproduced signal including a reproduced speech tone.

In the above-described second embodiment, the residual component that is specified by the index IDX and the normalization coefficient obtained through vector-quantization by the codebook 62 includes noise/nonvoice band components. However, the noise level and the speech level are adjusted based upon the normalization coefficient to assume an appropriate level ratio, and then sent to the decoding apparatus side. As a result, clearer speech can be heard at the decoding apparatus side even when the background noise is larger than the voice band, or the voice band is extremely low at the encoding apparatus side.

In accordance with the first and the second embodiments of the present invention, the voice band component, the nonvoice band component and the background noise component are discriminated by the encoding apparatus. However, discrimination may be performed by the decoding apparatus. For example, the same operations can be performed without changing conventional transmission formats. Also, in this arrangement, noises generated in the transmission system may be treated in the decoding apparatus.

In accordance with the present invention, as described above, a voice band component, a nonvoice band component and a background noise component are discriminated from an inputted signal. The level ratio between a speech component including nonvoice band and a background component is appropriately adjusted, and then the speech component and the background component are mixed to generate a reproduced signal. As a result, the clarity of the speech is improved because the level ratio between the speech component and the background noise component is appropriately adjusted, even when the background noise is large, or the voice band is small.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A speech transmission/reception system for transmitting and receiving signals including speech signals between a transmission side and a reception side, the system comprising:

a discrimination device at the transmission side that discriminates among a voice band component, a nonvoice band component and a noise component in an inputted speech signal;

an encoder at the transmission side for encoding the voice band and nonvoice band components;

a decoder at the reception side for decoding the encoded voice band and nonvoice band components;

a signal level control device at the reception side that controls respective signal levels among the decoded voice band component, the decoded nonvoice band component and the noise component as discriminated by the discrimination device according to a level ratio; and a reproducing device at the reception side that generates a reproduced speech signal by combining the voice band component, the nonvoice band component and the noise component as controlled by the level ratio control device.

2. A speech transmission/reception system according to claim 1, wherein the signal level control device is provided at the reception side for maintaining levels of the voice band component, the nonvoice band component and the noise component according to a predetermined level ratio.

3. A speech transmission/reception system for transmitting and receiving signals including speech signals, the system comprising:

a transmission side including:

a first discrimination device that extracts a voice band component from an inputted speech signal;

a second discrimination device that extracts a nonvoice band component and a noise component from the inputted speech signal;

a nonvoice band detector coupled to the second discrimination device, the nonvoice band detector receiving the nonvoice band component and the noise component extracted by the second discrimination device and detecting the presence or absence of the nonvoice band component;

an adder having a first input terminal for receiving the voice band component from the first discrimination device and a second input terminal;

a switch device coupling the nonvoice band detector and the second terminal of the adder and responsive to the nonvoice band detector;

a noise encoder coupled to the second discrimination device through the switch device for encoding the noise component to generate a noise code;

a speech signal encoder coupled to the adder for encoding synthesized speech output to generate a speech code output; and a multiplexer that multiplexes the speech code output and the noise code output to provide a multiplexed signal for transmission;

wherein the switch device provides the nonvoice band component to the second input terminal of the adder when the presence of the nonvoice band is detected by the nonvoice band detector, and provides the noise component to the noise encoder when the absence of the nonvoice band component is, detected by the nonvoice band detecter, and the adder combines the voice band component and the nonvoice band component to generate the synthesized speech output a reception side including:

a voice band amplifier for amplifying a decided voice band component by a first gain;

a nonvoice band amplifier for amplifying a decoded nonvoice band component by a second gain;

a signal level control device for controlling the first gain and the second gain such that the respective signal levels of the decoded voice and nonvoice components are maintained at a set level ratio.

4. A speech transmission/reception system according to claim 3, the system further comprising:

a demultiplexer that demultiplexes the multiplexed signal for transmission into the speech code output and the noise code output;

a speech decoder coupled to the demultiplexer that decodes the speech code output to generate a speech component;

a noise decoder coupled to the demultiplexer for decoding the noise code output to generate the noise component; and a reproducing device that combines the speech component and the noise component controlled by the signal level control device to generate a reproduced signal.

5. A speech transmission/reception system according to claim 4, wherein the signal level control device includes a level ratio setting device that provides the set level ratio between the respective signal levels of the speech component and the noise component.

6. A method of transmitting and receiving signals, including speech signals, between a transmission side and a reception side, the method comprising the steps of:

discriminating among a voice band component, a nonvoice band component and a noise component of an inputted speech signal at the transmission side;

controlling respective signal levels among the voice band component, the nonvoice band component and the noise component according to a level ratio at the reception side; and reproducing a reproduced signal by combining the voice band component, the nonvoice band component and the noise component based upon the level ratio.

7. A method according to claim 6, the method further including maintaining the respective signal levels of the voice band component, the nonvoice band component and the noise component according to a signal level of the noise component that is received at the reception side.

8. A method according to claim 6, the method further including controlling the respective signal levels of the voice band component, the nonvoice band component and the noise component according to a predetermined level ratio at the transmission side; and transmitting the controlled voice band, nonvoice and noise component signals to the reception side.

9. A method for transmitting and receiving signals including speech signals between a transmission system and a reception system, the method comprising the steps of:

extracting a voice band component from an inputted speech signal;

extracting a nonvoice band component and a noise component from the inputted speech signal;

extracting the nonvoice band component from the noise component;

adding the extracted voice band component and the extracted nonvoice band component to produce a speech component;

encoding the speech component to generate a speech code output at the transmission system;

encoding the noise component to generate a noise code output at the transmission system;

multiplexing the speech code output and the noise code output to generate a multiplexed signal for transmission;

amplifying a decoded speech component at the reception system at a first gain;

amplifying a decoded noise component at the reception system at a second gain; and controlling the first gain and the second gain at the reception system to maintain the respective signal levels of the decoded speech and noise components at a set level ratio.

10. A method according to claim 9, further comprising the steps of:

demultiplexing the multiplexed signal for transmission into the speech code output and the noise code output at the reception system;

decoding the speech code output at the reception system to generate the decoded speech component;

decoding the noise code output at the reception system to generate the decoded noise component; and combining the decoded speech component and the decoded noise component controlled according to the level ratio to generate a reproduced signal.

11. A method according to claim 10, wherein the step of controlling the gains at the reception side to maintain a level ratio includes the steps of:

providing a specified level ratio between the speech component and the noise component;

maintaining the level of the speech component based upon the specified level ratio; and maintaining the level of the noise component based upon the specified level ratio.

12. A method according to claim 10, the method further including controlling the respective signal levels of the speech component and the noise component according to a set level ratio at the reception side.

13. A method according to claim 10, the method further including maintaining the respective signal levels of the speech component and the noise component according to a signal level of the noise component that is received at the reception side.

14. A method according to claim 10, the method further including controlling the respective signal levels of the speech component and the noise component are controlled according to a level ratio at the transmission side; and transmitting the controlled speech component and noise component to the reception side.

15. A speech transmission/reception system for transmitting and receiving a signal between a transmission side and a reception side, the signal including a speech signal component and a noise component, the speech signal component including a voice band component and a nonvoice band component, the system comprising:

a transmission side including:

a first filter that extracts a voice band component from an inputted signal;

a second filter that extracts a nonvoice band component and a noise component from the inputted signal;

a nonvoice band detecter that extracts the nonvoice band component from the noise component;

an adder that adds the voice band component and the nonvoice band component to generate a speech component;

a speech signal encoder that encodes the speech component to generate a speech code output;

a noise encoder that encodes the noise component to generate a noise code output; and a multiplexer that multiplexes the speech code output and the noise code output to generate a multiplexed signal; and a reception side including:

a speech signal amplifier for amplifying a decoded speech component at a first gain;

a noise component amplifier for amplifying a decoded noise component at a second gain; and a level controller for controlling the first and second gain to maintain the respective levels of the decoded speech component and noise component at a set level ratio.

16. A system according to claim 15, further comprising:

a demultiplexer that demultiplexes the multiplexed signal into the speech code output and the noise code output;

a speech decoder that decodes the speech code output to provide the decoded speech component;

a noise decoder that decodes the noise code output to provide the decoded noise component; and a reproducing device that combines the decoded speech component and the decoded noise component controlled according to the level ratio to generate a reproduced signal.

17. A system according to claim 16, wherein a signal controller includes:

a level setting device that provides a specified ratio between the respective signal levels of the speech component and the noise component;

a speech level adjuster that maintains the signal level of the speech component based upon the specified level ratio; and a noise level adjuster that maintains the level of the noise component based upon the specified level ratio.

* * * * *